US009021616B2

(12) United States Patent
Baty

(10) Patent No.: US 9,021,616 B2
(45) Date of Patent: May 5, 2015

(54) PROTECTIVE GEAR

(71) Applicant: David Baty, Issaquah, WA (US)

(72) Inventor: David Baty, Issaquah, WA (US)

( * ) Notice: Subject to any disclaimer, the term of this patent is extended or adjusted under 35 U.S.C. 154(b) by 0 days.

(21) Appl. No.: 13/800,703

(22) Filed: Mar. 13, 2013

(65) Prior Publication Data

US 2013/0283507 A1 Oct. 31, 2013

Related U.S. Application Data

(60) Provisional application No. 61/637,930, filed on Apr. 25, 2012.

(51) Int. Cl.
*A42B 3/14* (2006.01)
*A42B 3/06* (2006.01)

(52) U.S. Cl.
CPC .. *A42B 3/14* (2013.01); *A42B 3/064* (2013.01)

(58) Field of Classification Search
CPC ..... A42B 3/00; A42B 3/06; A42B 3/064; A42B 3/10; A42B 3/14; A42B 3/142; A42B 3/145; A42B 3/147
USPC ..... 2/416, 410, 425, 6.8, 411, 417, 418, 2/419, 420, 421, 422
See application file for complete search history.

(56) References Cited

U.S. PATENT DOCUMENTS

| | | | | |
|---|---|---|---|---|
| 631,880 | A * | 8/1899 | Ross | 2/418 |
| 1,770,376 | A | 7/1930 | Bullard | |
| 2,250,275 | A | 7/1941 | Riddell | |
| 2,504,979 | A * | 4/1950 | Hornsby, Jr. | 2/419 |
| 2,585,937 | A | 2/1952 | Johnson et al. | |
| 2,715,227 | A * | 8/1955 | Turner | 2/182.1 |
| 2,739,310 | A * | 3/1956 | Frieder et al. | 2/418 |
| 2,879,513 | A | 3/1959 | Hornickel et al. | |
| 2,892,194 | A * | 6/1959 | Lee et al. | 2/416 |
| 2,969,546 | A | 1/1961 | Morgan, Jr. | |
| 3,028,602 | A * | 4/1962 | Miller | 2/6.1 |
| 3,110,900 | A | 11/1963 | Crowdes, Jr. | |
| 3,237,201 | A | 3/1966 | Morgan | |
| 3,422,459 | A | 1/1969 | Bowers, Jr. | |

(Continued)

FOREIGN PATENT DOCUMENTS

| | | |
|---|---|---|
| EP | 2 399 472 A1 | 12/1928 |
| EP | 0 365 433 A1 | 4/1990 |

(Continued)

OTHER PUBLICATIONS

ASTM International, "Standard Performance Specification for Ice Hockey Helmets," Designation F1045-07, Mar. 24, 2011, 10 pages.

(Continued)

*Primary Examiner* — Alissa L Hoey
(74) *Attorney, Agent, or Firm* — Seed IP Law Group PLLC

(57) ABSTRACT

Protective gear is provided, such as, for example, protective headgear that includes a rigid helmet structure, an engagement system configured to engage a user's head, and a plurality of tethering devices coupled between the engagement system and the rigid helmet structure to suspend the rigid helmet structure from the user's head when the protective headgear is worn. The protective headgear further includes at least one damper coupled to one or more of the plurality of tethering devices to resist motion of the rigid helmet structure relative to the engagement system when the rigid structure is impacted during an impact event.

29 Claims, 8 Drawing Sheets

(56) References Cited

U.S. PATENT DOCUMENTS

| | | | | | |
|---|---|---|---|---|---|
| 3,447,163 | A | | 6/1969 | Bothwell et al. | |
| 3,555,560 | A | | 1/1971 | Rascke | |
| 3,590,388 | A | | 7/1971 | Holt | |
| 3,609,765 | A | * | 10/1971 | Molitoris | 2/418 |
| 3,633,214 | A | | 1/1972 | Newcomb | |
| 3,696,442 | A | * | 10/1972 | Amundsen et al. | 2/8.1 |
| 3,872,511 | A | | 3/1975 | Nichols | |
| 3,938,627 | A | | 2/1976 | Nagazumi | |
| 3,950,788 | A | | 4/1976 | Lamb | |
| 4,035,847 | A | | 7/1977 | Prince et al. | |
| 4,044,400 | A | * | 8/1977 | Lewicki et al. | 2/421 |
| 4,055,860 | A | | 11/1977 | King | |
| 4,106,127 | A | | 8/1978 | Marangoni et al. | |
| 4,198,710 | A | | 4/1980 | Lamb | |
| 4,286,339 | A | | 9/1981 | Coombs | |
| 4,345,338 | A | * | 8/1982 | Frieder et al. | 2/414 |
| 4,407,021 | A | | 10/1983 | Kralik et al. | |
| 4,423,524 | A | | 1/1984 | Kralik et al. | |
| 4,461,044 | A | * | 7/1984 | Reiterman et al. | 2/421 |
| 4,527,290 | A | | 7/1985 | Zahn | |
| 4,679,253 | A | | 7/1987 | Mitchell et al. | |
| 4,942,628 | A | | 7/1990 | Freund | |
| 5,042,093 | A | | 8/1991 | Legendre | |
| 5,068,922 | A | | 12/1991 | Zahn | |
| 5,077,839 | A | * | 1/1992 | Keller | 2/421 |
| 5,150,479 | A | | 9/1992 | Oleson | |
| 5,237,704 | A | | 8/1993 | Phippen | |
| 5,319,808 | A | | 6/1994 | Bishop et al. | |
| 5,450,631 | A | | 9/1995 | Egger | |
| 5,575,017 | A | * | 11/1996 | Hefling et al. | 2/418 |
| 5,685,020 | A | * | 11/1997 | Powell et al. | 2/421 |
| 5,694,649 | A | * | 12/1997 | Hefling et al. | 2/418 |
| 5,815,847 | A | * | 10/1998 | Holden, Jr. | 2/418 |
| 5,893,174 | A | * | 4/1999 | Primeau | 2/424 |
| 5,983,405 | A | * | 11/1999 | Casale | 2/421 |
| 6,032,297 | A | * | 3/2000 | Barthold et al. | 2/416 |
| 6,081,931 | A | | 7/2000 | Burns et al. | |
| 6,128,786 | A | | 10/2000 | Maddux et al. | |
| 6,154,889 | A | * | 12/2000 | Moore et al. | 2/418 |
| 6,256,798 | B1 | * | 7/2001 | Egolf et al. | 2/421 |
| 6,311,338 | B1 | * | 11/2001 | Galet | 2/421 |
| 6,385,780 | B1 | | 5/2002 | Racine | |
| 6,401,260 | B1 | | 6/2002 | Porth | |
| 6,481,023 | B2 | | 11/2002 | Wise et al. | |
| 6,609,254 | B2 | * | 8/2003 | Bielefeld et al. | 2/416 |
| 6,681,409 | B2 | | 1/2004 | Dennis et al. | |
| 6,751,808 | B2 | | 6/2004 | Puchalski | |
| 6,865,752 | B2 | * | 3/2005 | Udelhofen et al. | 2/425 |
| 6,868,560 | B2 | | 3/2005 | Bostock | |
| 6,968,576 | B2 | * | 11/2005 | McNeil et al. | 2/425 |
| 7,120,939 | B1 | * | 10/2006 | Howard et al. | 2/416 |
| 7,124,449 | B2 | | 10/2006 | Sutter et al. | |
| 7,222,374 | B2 | | 5/2007 | Musal et al. | |
| 7,299,505 | B2 | | 11/2007 | Dennis et al. | |
| 7,381,460 | B2 | | 6/2008 | Palmer et al. | |
| 7,565,704 | B2 | * | 7/2009 | Wu | 2/418 |
| 7,673,351 | B2 | | 3/2010 | Copeland et al. | |
| 7,770,239 | B1 | | 8/2010 | Goldman et al. | |
| 7,849,525 | B2 | * | 12/2010 | Ghajar | 2/416 |
| 7,865,968 | B2 | * | 1/2011 | Lilenthal et al. | 2/8.2 |
| 7,870,617 | B2 | | 1/2011 | Butler | |
| 7,895,681 | B2 | | 3/2011 | Ferrara | |
| 7,941,873 | B2 | * | 5/2011 | Nagely et al. | 2/425 |
| 8,069,498 | B2 | | 12/2011 | Maddux et al. | |
| 8,161,576 | B2 | * | 4/2012 | Lemke et al. | 2/418 |
| 8,261,374 | B2 | * | 9/2012 | Petzl et al. | 2/418 |
| 8,353,066 | B2 | * | 1/2013 | Rogers et al. | 2/421 |
| 8,359,672 | B2 | * | 1/2013 | Moelker | 2/418 |
| 8,370,967 | B2 | * | 2/2013 | Chen | 2/418 |
| 8,434,200 | B2 | * | 5/2013 | Chen | 24/68 SK |
| 2002/0116749 | A1 | * | 8/2002 | Bielefeld et al. | 2/416 |
| 2003/0088906 | A1 | * | 5/2003 | Baker | 2/416 |
| 2004/0117897 | A1 | * | 6/2004 | Udelhofen et al. | 2/421 |
| 2004/0194194 | A1 | * | 10/2004 | McNeil et al. | 2/421 |
| 2005/0138719 | A1 | * | 6/2005 | Huh | 2/416 |
| 2005/0204456 | A1 | * | 9/2005 | Piper et al. | 2/411 |
| 2005/0217006 | A1 | * | 10/2005 | Sutter et al. | 2/416 |
| 2006/0010579 | A1 | * | 1/2006 | Wiles | 2/410 |
| 2006/0048285 | A1 | * | 3/2006 | Bielefeld et al. | 2/416 |
| 2006/0080761 | A1 | * | 4/2006 | Huh | 2/424 |
| 2006/0179537 | A1 | * | 8/2006 | Dennis et al. | 2/6.6 |
| 2007/0245464 | A1 | * | 10/2007 | Baker | 2/411 |
| 2008/0092279 | A1 | * | 4/2008 | Chiang | 2/425 |
| 2008/0209617 | A1 | * | 9/2008 | Castillo | 2/461 |
| 2008/0313791 | A1 | * | 12/2008 | Nagely | 2/425 |
| 2009/0038055 | A1 | * | 2/2009 | Ferrara | 2/421 |
| 2009/0210998 | A1 | * | 8/2009 | Rolla | 2/411 |
| 2009/0320187 | A1 | * | 12/2009 | Petzl et al. | 2/417 |
| 2010/0115686 | A1 | | 5/2010 | Halldin | |
| 2010/0258988 | A1 | | 10/2010 | Darnell et al. | |
| 2010/0319109 | A1 | * | 12/2010 | Field | 2/421 |
| 2011/0047679 | A1 | * | 3/2011 | Rogers et al. | 2/414 |
| 2011/0067158 | A1 | * | 3/2011 | Lee | 2/15 |
| 2011/0088148 | A1 | * | 4/2011 | Chen | 2/418 |
| 2011/0094018 | A1 | * | 4/2011 | Rogers et al. | 2/421 |
| 2011/0191946 | A1 | * | 8/2011 | Fang | 2/418 |
| 2012/0198604 | A1 | | 8/2012 | Weber et al. | |
| 2012/0222197 | A1 | | 9/2012 | Nagely et al. | |

FOREIGN PATENT DOCUMENTS

| | | | |
|---|---|---|---|
| EP | 0 470 746 | A2 | 2/1992 |
| EP | 0 942 663 | B1 | 9/1999 |
| EP | 1026968 | B1 | 8/2000 |
| EP | 1 061 821 | B1 | 12/2000 |
| EP | 2 359 707 | A1 | 8/2011 |
| EP | 2 389 823 | A1 | 11/2011 |
| WO | 2010/059989 | A2 | 5/2010 |
| WO | 2011/090381 | A1 | 7/2011 |

OTHER PUBLICATIONS

Canadian Standards Association, "Recreational alpine skiing and snowboarding helmets—Z263.1-08," Jun. 2008, 38 pages.

National Highway Traffic Safety Administration, "§571.218 Standard No. 218; Motorcycle helmets," Aug. 20, 1973, last amended Apr. 15, 1988, pp. 643-659.

National Operating Committee on Standards for Athletic Equipment, "Standard Performance Specification for Newly Manufactured Football Helmets," NOCSAE Doc (ND)002-11m12, Modified May 2012, 8 pages.

National Operating Committee on Standards for Athletic Equipment, "Standard Test Method and Equipment Used in Evaluating the Performance Characteristics of Protective Headgear/Equipment," NOCSAE Doc (ND) 001-11m11 Revised Jan. 2011, 29 pages.

Snell Memorial Foundation, "2010 Standard for Protective Headgear," 2010, 21 pages.

International Search Report, mailed Jul. 24, 2013, for PCT/US2013/037641, 5 pages.

* cited by examiner

PROTECTIVE GEAR

CROSS-REFERENCE TO RELATED APPLICATION

This application claims the benefit under 35 U.S.C. §119 (e) of U.S. Provisional Patent Application No. 61/637,930, filed Apr. 25, 2012, where this provisional application is incorporated herein by reference in its entirety.

BACKGROUND

1. Technical Field

This disclosure relates generally to protective gear and, more particularly, to personal protective gear, such as helmets, including one or more dampers to protect against impacts.

2. Description of the Related Art

The performance of protective gear, such as, for example, protective headgear in the form of helmets, is especially important when the risk and nature of the injuries is more severe. Impacts to the head, for example, can lead to mild or traumatic brain injuries that can lead to long-term and cumulative impairments. Various helmet standards and assessments are known to qualify the level of a helmet's performance. A helmet's impact performance is typically assessed by the acceleration measured within a helmeted headform during an impact. Most standards consider only linear, direct impacts, not oblique impacts or other impacts causing rotational acceleration. Rotational acceleration is believed to be an important factor in many concussions and traumatic brain injuries. Moreover, many current standards evaluate only higher velocity impacts more relevant to skull fractures than milder concussions, which are of growing concern.

Most helmets and other personal protective equipment use crushable materials or structures to manage impact forces. Examples of crushable foam include expanded polystyrene (EPS), Expanded Polypropylene (EPP) or thermoplastic blown foam. Examples of crushable structures include those shown in U.S. Pat. Nos. 7,673,351 and 8,069,498, and U.S. Patent Application Publication No. 2010/0258988. These crushable foams and structures have several performance shortcomings. Primarily, they are generally rate insensitive and nonlinear in their response. They can only be "tuned" to a limited range of impact velocities, such as those usually necessary to pass certification standards, so they may not adequately protect in lower velocity impacts that may nevertheless result in concussions. They generally respond nonlinearly during an impact. For example, there is often a delay following impact before such materials start significantly managing impact energy. Crushable materials and structures generally act like non-linear springs and most rebound too strongly after reaching peak displacement. This increases the duration of acceleration, which degrades or compromises a helmet's impact performance.

Linear impact performance is a function of the thickness or distance available to manage the impact. A common technique to improve helmet impact performance is to increase the standoff, or space between the shell and cranium. These helmets are called high standoff helmets. There is a limit to how big a helmet can be, however, and still be acceptable ergonomically, aesthetically, and from personal preferences. Many people prefer smaller helmets. Crushable foams and structures waste space. Crushable materials and structures generally do not crush enough to be effective. They typically have a fully crushed size that is too large, often as great as thirty percent of their pre-impact size even at the highest impact velocities called for in helmet standards. Helmets using such structures typically also leave extra space for fitment or comfort padding and positioning devices that have no functional role in active impact management.

Impact managing capabilities for crushable materials and structures is also a function of the breadth of the coverage area. The larger the coverage area, the greater the impact managing capability. Most crushable materials and structures have a coverage area of such extent that it inhibits heat transfer. Overheating is a common problem associated with these types of helmets.

Most protective headgear does not adequately manage oblique impacts, and oblique impacts may be one of the most common types of impact. By design, crushable materials and structures deform during an impact as the cranium "beds down" into the crushable material or structure in the process of managing the impact. This, in effect, fixes the head in place relative to the outer shell. Because of this, there is a logical and severe performance limit for these helmets to manage oblique impacts, which have both rotational and linear acceleration components.

A few methods have been proposed to try to mitigate this behavior. In one class, an attempt is made to provide more rotational freedom for the crushable impact liner to move relative to the hard outer shell. MIPS helmet technology adds a lower friction layer between the shell and crushable foam. In another method, described in U.S. Patent Application Publication No. 2012/0198604, an impact liner is divided into two concentric shapes with a flexible structure placed between them. A logical limit of both approaches is the asymmetrical shapes of heads and helmets that limit the amount of rotational movement between the hard shell and the crushable liner before there must be deformation (and therefore resistive force) of the crushable liner as it tries to rotate to an extent where the two shapes become increasingly mismatched. This shape mismatch is greater for lateral impacts because heads are more flat on the sides than on the top. Lateral impacts are arguably the most common of the oblique impacts. A further disadvantage of the method described in U.S. Patent Application Publication No. 2012/0198604 is that the standoff distance is increased significantly to accommodate the flexible standoffs between the layers. Many fitting means are also known that provide a secure fit but also further lock the head in pace relative to the outer shell, thereby, in most cases, limiting the helmet's ability to manage the rotational acceleration that is transmitted from the outer shell.

Superskin™ as provided by Lazer SA of Belgium seeks to lower the friction between the outer shell of a helmet and the impacting surface with the application of a lower friction gel like skin on the outside of the helmet. This can also be accomplished by making the outside of the helmet lower friction by other means such as using a harder shell, but using this approach will not mitigate all causes of rotational acceleration.

Shear thickening materials (e.g., d3o, Poron XRD) provide a rate sensitive response to different impact velocities. These materials may still suffer, however, from the other shortcomings of crushable foams and structures mentioned above, as well as having limited range. In helmet applications, they are mostly used to supplement, not replace, another crushable material or structure. A variation on a crushable structure is the vented air bladder of U.S. Pat. Nos. 7,895,681 and 3,872,511. These devices may provide improved rate sensitivity, but still have a minimal crush size, require a substantial size bladder and supporting bonnet, and are not as tunable as is desirable and possible with embodiments of the protective gear described herein.

BRIEF SUMMARY

Embodiments described herein provide protective gear, such as helmets, having improved performance. Impact management systems and related methods are also provided that address many of the limitations of crushable materials and structures and other conventional impact energy management systems as discussed above.

Embodiments of the protective gear described herein may comprise three main structural components: an outer rigid structure, at least one damper configured to resist motion via viscous friction, and a plurality of tethering devices that transfer impact energy between the outer rigid structure and the at least one damper. At a functionally basic level, an external impact, or "push," results in a "pull" on the at least one damper through one or more of the plurality of tethering devices that are put under tension. As depicted in the figures, many embodiments are possible to achieve this structural arrangement and the aforementioned functionality. This arrangement and functionality provide several improvements over known systems.

Some of the plurality of tethering devices are placed under tension during an impact to the outer rigid structure and effectively redirect impact forces to the at least one damper. The tethering devices can be flexibly structured. The at least one damper can also be flexibly structured and located. Because of this flexibility, many design advantages can be realized. Several examples are included that are meant to be illustrative and not exhaustive.

Advantages include minimizing or otherwise removing dampening devices from an impact managing space. More particularly, since the at least one damper may be flexibly placed and structured, it can be placed outside of the impact managing space or made sufficiently small when placed within the impact managing space. The design flexibility of the tethering devices enables them to be made such that they occupy a small portion of the impact managing space. This allows more of the standoff space to be used for impact management. The tethering devices and associated head engagement system can be relatively thin and the at least one damper can be placed outside the standoff space so as to provide a significant space advantage.

Another advantage is the possible elimination of the necessity for space-inefficient adjusting or comforting structures. More particularly, because fitment and adjustment systems can be more naturally integrated with the tethering devices and/or dampers, a separate fit adjusting device is not a necessity. Consequently, what would otherwise be wasted space from an impact dampening perspective becomes functional space contributing to improved impact management capability within the same standoff space.

Still yet another advantage is that ideal dampening behavior can be more readily achieved or approximated. For instance, the use of dashpots having a response curve defined by a generally constant and lower magnitude stopping force can lead to more ideal dampening behavior of the helmet. Readily available dashpot/shock absorber technology, such as, for example, the hydraulic based miniature shock absorber product lines from Ace Controls, Weforma, and Zimmer-GMBH, comes closer to ideal performance characteristics that are also desired in embodiments of the protective headgear described herein. In fact, embodiments are designed such that the advantages of current dashpot/shock absorber technology can be readily adapted. Ideal dashpot/shock absorber behavior supports ideal impact response behavior (i.e., instant response that is rate sensitive without the rebound over a wider performance range and with an overall "flat and low" acceleration management curve) by the protective headgear described herein.

Some other advantages include better management of oblique impacts arising from, among other things, more rotational freedom of the user's head relative to the rigid outer structure. More particularly, because embodiments described herein do not bed-down in one place while managing impacts (as is typical of prior art cushioning structures), the rigid outer structure is able to rotate relative to the head more freely while still maintaining sufficient impact-managing capacity. The dampers (e.g., dashpots) and tethering devices can be made with sufficient range to allow for the management of both rotational and linear displacements.

Moreover, because of the design flexibility associated with disclosed embodiments, the head engagement system can be configured such that it more freely and fully (or partially) floats or rotates relative to the rigid outer structure. The "free" rotation or float may act independently of the dampening structures. Some embodiments may also include a supplemental dampening or repositioning device that is tuned to manage rotational forces.

Another advantage is that embodiments described herein may provide protective headgear that exhibits better heat management than conventional helmets. For example, embodiments include significant gaps or spaces between the rigid outer structure and the head engagement system to allow for better heat dissipation from, among other things, greater air circulation throughout the protective headgear.

Still further, embodiments described herein may provide superior impact protection in a similarly sized form factor or provide comparable impact protection in a smaller form factor when compared to conventional protective headgear.

Overall, embodiments described herein provide protective gear, such as headgear, in particularly efficient and versatile form factors.

For example, in some embodiments, protective headgear may be summarized as including a rigid structure defining a head receiving cavity; an engagement system configured to engage a user's head when the protective headgear is worn; a plurality of tethering devices that couple the engagement system to the rigid structure with the rigid structure offset from the engagement system to provide a standoff space therebetween, and to enable the engagement system and the rigid structure to move relative to each other during impact events; and at least one damper configured to resist motion via viscous friction, the at least one damper coupled to at least one of the plurality of tethering devices and configured to resist motion of the rigid structure relative to the engagement system when the rigid structure is impacted during an impact event.

In other embodiments, protective headgear may be summarized as including a rigid helmet structure defining a head receiving cavity; an engagement system configured to engage a user's head when the protective headgear is worn; a plurality of tethering devices coupled between the engagement system and the rigid helmet structure to suspend the rigid helmet structure from the user's head when the protective headgear is worn; and at least one damper including a dashpot (or other motion restricting device) coupled to one or more of the plurality of tethering devices to resist motion of the rigid helmet structure relative to the engagement system when the rigid structure is impacted during an impact event. The damper may include a wide variety of motion restricting devices and mechanisms, including those that deform elastically or plastically or some combination of both.

DETAILED DESCRIPTION

Figure 1:
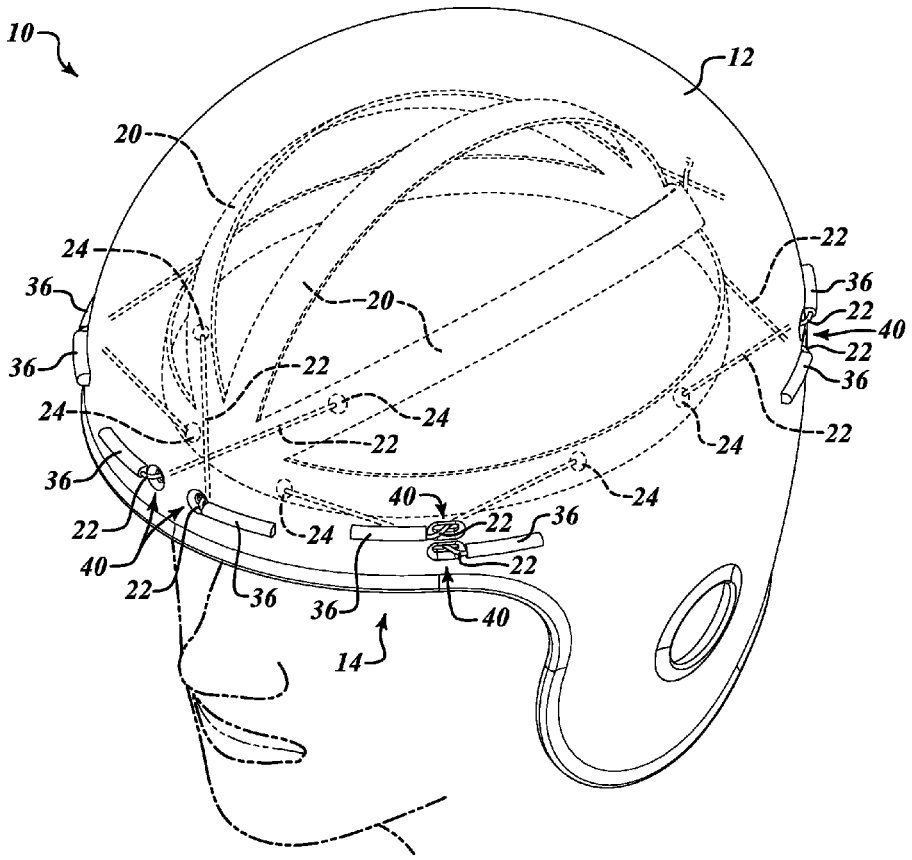
FIG. 1 is an isometric view of an article of protective headgear, according to one embodiment, in the form of a helmet.

In the following description, certain specific details are set forth in order to provide a thorough understanding of various disclosed embodiments. However, one of ordinary skill in the relevant art will recognize that embodiments may be practiced without one or more of these specific details. In other instances, well-known structures and devices associated with personal protective gear may not be shown or described in detail to avoid unnecessarily obscuring descriptions of the embodiments. For example, it will be appreciated by those of ordinary skill in the relevant art that features and aspects of the protective gear described may be combined with common features of known protective gear. For instance, the protective helmets described herein may include various cushioning or padding to supplement the one or more viscous dampening elements provided for managing impacts to the helmets or to assist in fitting the helmets to users. In addition, the protective helmets described herein may include various fit adjustment devices, such as, for example, adjustable chin straps, adjustable bands and adjustable harnesses, as well as face guards and shields and "full face" configurations.

In addition, it will be appreciated that the embodiments shown and described herein or non-limiting examples and that commercial embodiments of protective gear incorporating aspects of the structures and functionalities described herein may vary significantly from the embodiments illustrated in the figures. For example, many helmet safety standards call for substantially smooth external and internal surfaces. Accordingly, an external fairing or outer shell may be provided in embodiments featuring externally mounted dampers to cover and conceal the same and may be configured to offer minimal resistance to tangential or oblique impact forces. Any internal projections may also be covered or concealed to avoid laceration and/or puncture hazards.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Embodiments described herein provide protective gear, such as headgear, in particularly efficient and versatile form factors.

FIGS. 1 through 5 show one example embodiment of a particularly advantageous article of protective headgear in the form of a helmet 10 wearable by a user to protect against impacts to the user's head. The helmet 10 includes an outer rigid structure 12 defining a head receiving cavity 14. The outer rigid structure 12 may comprise a shell structure made of common materials for helmets, such as, for example, polycarbonate plastic, fiberglass, or Kevlar, or other suitable materials. The helmet 10 further includes a head engagement system 20 that is configured to engage a user's head when the helmet 10 is worn and a plurality of tethering devices 22 that couple the head engagement system 20 to the outer rigid structure 12. The tethering devices 22 may couple the head engagement system 20 to the outer rigid structure 12 with the outer rigid structure 12 offset from the head engagement system 20 to provide a standoff space therebetween. The standoff space may be generally uniform or may vary in magnitude at different locations throughout the helmet 10. The tethering devices 22 may be in the form of flexible elongated structures, such as, for example, cables, bands, flexible rods, straps, ropes, wires or other structures.

Figure 3:
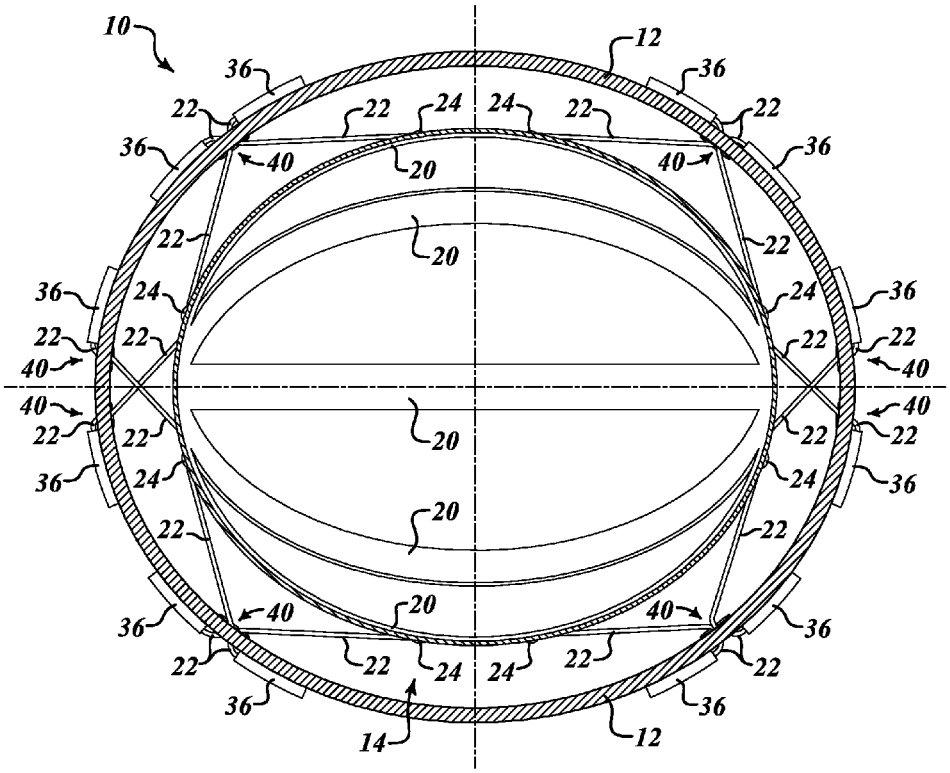
FIG. 3 is a bottom cross-sectional view of the protective headgear of FIG. 1 taken along line 3-3 in FIG. 2, showing the protective headgear in a pre-impact configuration.
Figure 4:
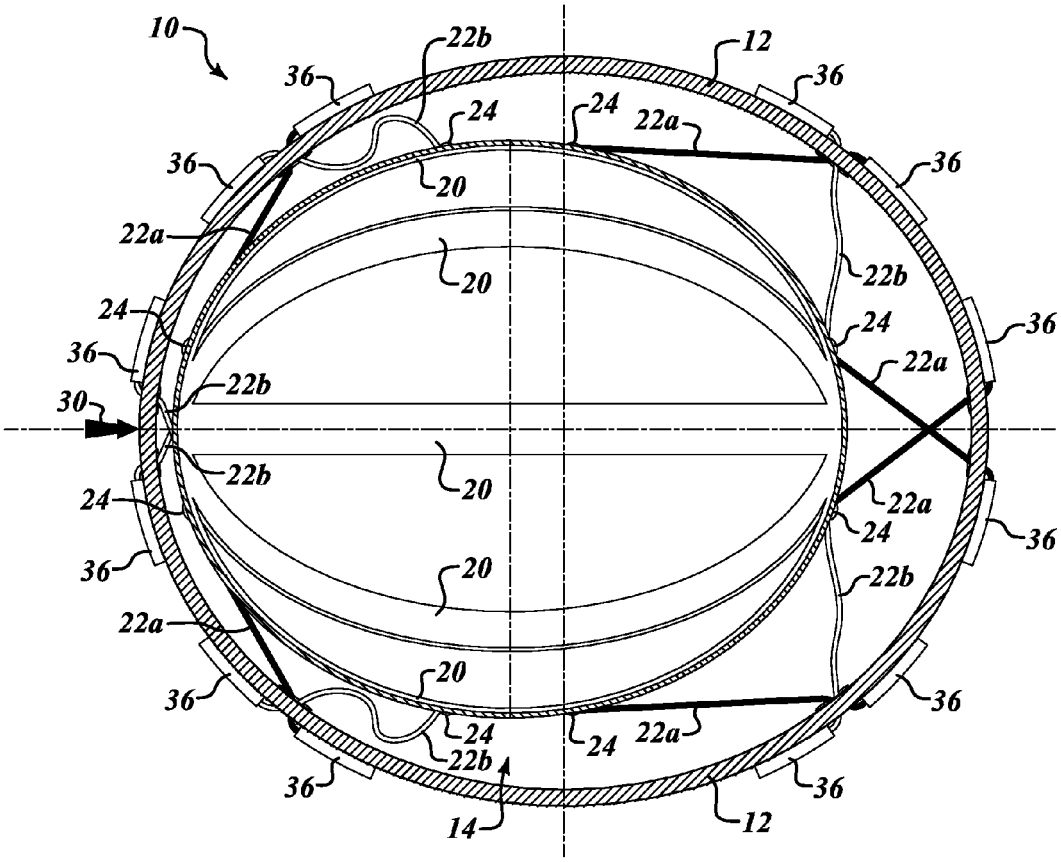
FIG. 4 is also a bottom cross-sectional view of the protective headgear of FIG. 1 taken along line 3-3 in FIG. 2, but with the protective headgear in a post-impact configuration.
Figure 5:
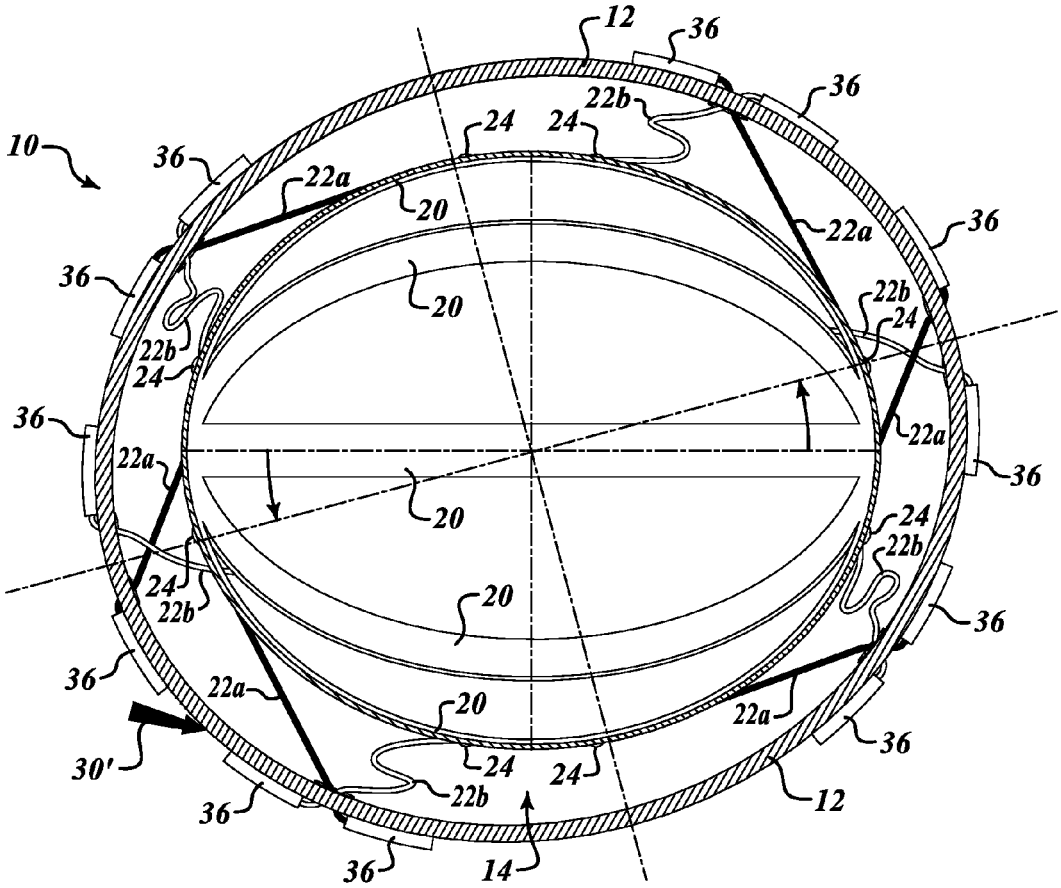
FIG. 5 is yet another bottom cross-sectional view of the protective headgear of FIG. 1 taken along line 3-3 in FIG. 2, but with the protective headgear in an oblique impact configuration.

The tethering devices 22 enable the head engagement system 20 and the outer rigid structure 12 to move relative to each other during impact events. More particularly, during an impact event, the outer rigid structure 12 may be displaced toward the head engagement system 20 near the area of impact, as illustrated in FIG. 4, for example, causing some of the tethering devices 22*a* to increase in tension and become particularly taut, while causing other tethering devices 22*b* to decrease in tension, and in some cases become slack. For illustrative purposes, FIG. 3 shows the helmet 10 in a pre-impact configuration in which the head engagement system 20 is generally centrally located within the head receiving cavity 14 and FIG. 4 shows the helmet 10 in a post-impact configuration in which the outer rigid structure 12 is shifted toward the head engagement system 20 near the area of impact, as represented by the arrow labeled 30. FIG. 5 shows the helmet 10 in another post-impact configuration in which the outer rigid structure 12 is rotated relative to the head engaging system 20, as may be expected during an oblique impact event as represented by the arrow labeled 30'. It is appreciated that in most instances there will the outer rigid structure 12 will also shift toward the head engagement system 20 near the area of impact (i.e., the outer rigid shell 12 will experience a combination of rotational and linear displacement relative to the head engagement system 20 in most impacts). It is also appreciated that there are numerous post-impact configurations that are possible, which depend on several factors including, for example, the velocity of impact and the direction of impact.

As shown in FIGS. 1 through 5, the tethering devices 22 may be arranged between the outer rigid structure 12 and the head engaging system 20 such that at least two of the tethering devices 22 experience an increase in tension as the outer rigid structure 12 is struck from various directions, including for example, from head on, from each side, from the rear and from downward on top of the rigid out structure 12. The tethering devices 22 may operate in functionally opposite sets or subgroups such that, for example, during a head on impact a first set or subgroup of the tethering elements undergo an increase in tension while a second set or subgroup of functionally opposite tethering devices 22 decreases in tension or become slack, and such that during an impact from the rear the first set or subgroup of tethering devices decreases in tension or become slack and the second set or subgroup undergo an increase in tension. Further, as shown best in FIG. 2, some of the tethering devices 22 may be arranged to act generally within a horizontal plane positioned at a height near the user's forehead, and other tethering devices 22 may be inclined relative thereto. In general, the tethering devices 22 can be arranged in nearly limitless positions and orientations to collectively protect against impacts to the rigid outer structure from all directions.

Figure 1A:
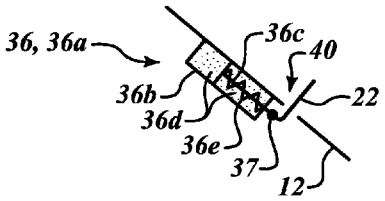
FIG. 1*a* is a schematic representation of a damper in the form of a linear dashpot having a base, an actuator and a spring that may be used with various embodiments of the protective headgear described herein, including the helmet shown in FIG. 1.
Figure 2:
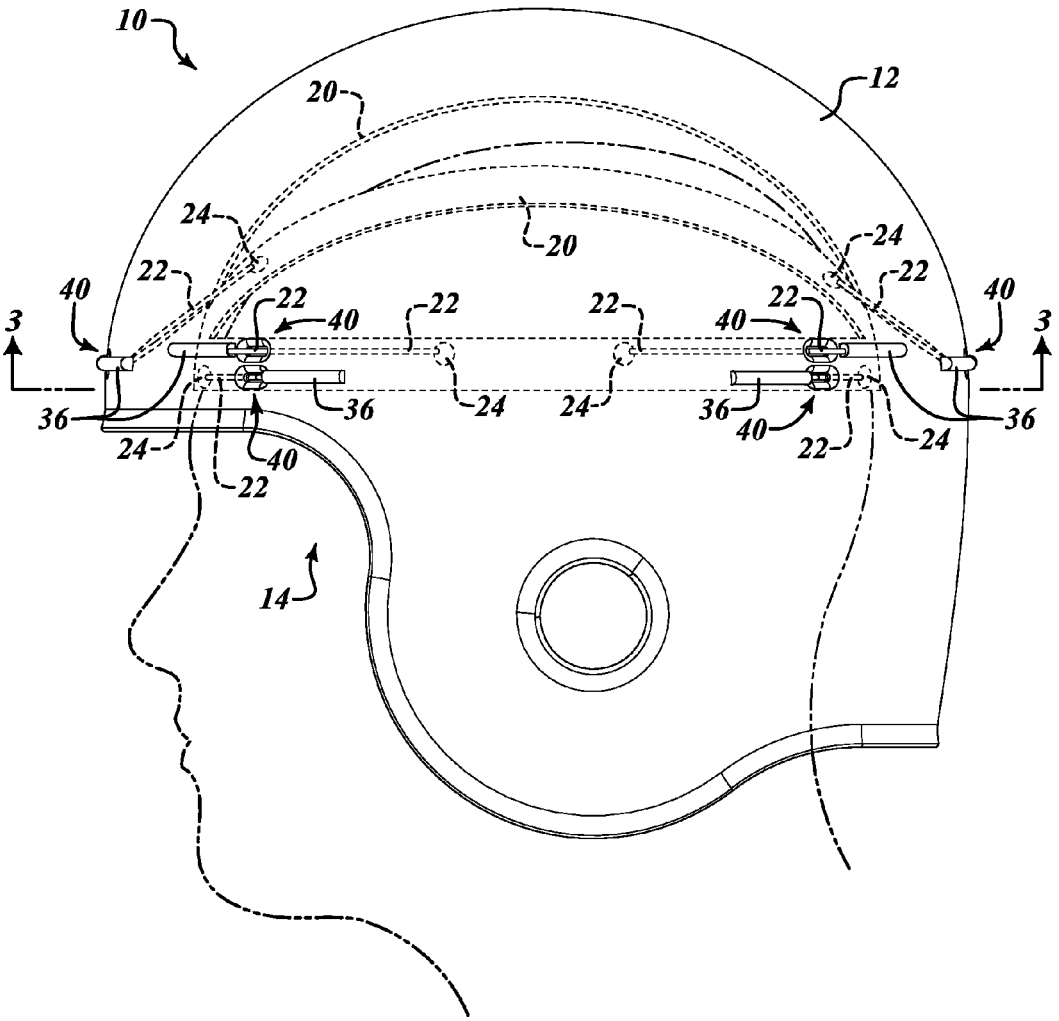
FIG. 2 is a side elevational view of the protective headgear of FIG. 1.

With continued reference to FIGS. 1 through 5, the helmet 10 further includes a plurality of dampers 36, such as, for example, mechanical dashpots, that are each configured to resist motion via viscous friction. As shown schematically in FIG. 1A, the dampers 36 may comprise a linear dashpot 36*a* having a base 36*b* and an actuator 36*c* movable relative to the base 36*b* with movement of the actuator 36*c* being guided and constrained by the base 36*b*. Upon activation and movement of the actuator 36*c* relative to the base 36*b*, interceding fluid 36*d* is forced to flow through an orifice(s) or channels or other flow-restricting feature (not shown) to assist in resisting motion via viscous friction. The dampers 36 may also include one or more spring elements 36*e* to help provide supplemental tension (or pre-tension) and/or a restorative force sufficient to reposition the helmet structures to a pre-impact configuration. Each damper 36 of the helmet 10 shown in FIGS. 1-5 is coupled to at least one of the plurality of tethering devices 22, as illustrated by connection point 37, and is configured to resist motion of the outer rigid structure 12 relative to the head engagement system 20 when the outer rigid structure 12 is impacted during an impact event. More particularly, the base 36*b* of each damper 36 is shown fixed to the outer rigid structure 12 of the helmet 10 with the actuator 36*c* fixedly attached to one of opposing ends a respective one of the flexible tethering devices 22 while the other end of the flexible tethering device 22 is fixedly attached to the head engagement system 20 (illustrated as a bonnet structure in FIGS. 1-5) at anchor connections 24. In this manner, relative movement between the rigid structure 12 of the helmet 10 and the head engagement system 20 (e.g., bonnet structure) during an impact event is resisted by one or more of the dampers 36 as the corresponding flexible tethering device 22 attached thereto causes the actuator 36*c* of the damper 36 to move relative to the base 36*b*.

As can be appreciated from FIGS. 1 through 5, the dampers 36 are arranged on the rigid structure 12 of the helmet 10 and oriented relative to the flexible tethering devices 22 to resist motion as the relevant damper(s) 36 are acted upon by a pulling force from the corresponding flexible tethering devices 22*a* (see FIGS. 4 and 5) during an impact event.

As can also be appreciated from FIGS. 1 through 5, the rigid structure 12 of the helmet 10 may be connected to and suspended from the head engagement system 20 (e.g., bonnet structure) solely by the plurality of flexible tethering devices 22 and the dampers 36 such that relative movement between the rigid structure 12 of the helmet 10 and head engagement system 20 (e.g., bonnet structure) during an impact event is resisted by one or more of the dampers 36 as the relative movement causes corresponding movement of the flexible tethering devices 22 and in turn corresponding movement of each actuator 36*c* of the one or more dampers 36 relative to the base 36*b*.

With reference in particular to FIG. 4, the flexible tethering devices 22 may be arranged with one or more of the flexible tethering devices 22 extending between the head engagement system 20 (e.g., bonnet structure) and the rigid structure 12 of the helmet 10 at a front end of the helmet 10 and with one or more of the flexible tethering devices 22 extending between the head engagement system 20 (e.g., bonnet structure) and the rigid structure 12 of the helmet 10 at a different location other than the front end such that, when the rigid structure 12 of the helmet 10 and the head engagement system 20 (e.g., bonnet structure) are in an impact configuration corresponding to a front impact, as illustrated in FIG. 4, the one or more flexible tethering devices 22 at the different location (e.g., the tethering devices 22*a* located at the rear end and sides of the helmet 10) are taut while the one or more of the flexible tethering devices 22*b* at the front end of the helmet 10 are slack.

As can be appreciated from the arrangement shown in FIG. 4, the dampers 36 may be arranged generally tangential to the rigid structure 12 of the helmet 10 such that, when an impact event causes the rigid structure 12 to move relative to the head engagement system 20 (e.g., bonnet structure) out of a pre-impact configuration, one or more of the dampers 36 may resist motion of the rigid structure 12 relative to the head engagement system 20 (e.g., bonnet structure) as the relevant flexible tethering devices 22*a* attached thereto pulls the actuator 36*c* in a direction that is not aligned with a direction of the impact event, represented by the arrow labeled 30. For example, the pair of dampers 36 shown at the rear end of the helmet 10 in FIG. 4 are arranged such that the corresponding tethering devices 22*a* attached thereto pull on the dampers 36 in different directions that are nearly perpendicular to the head-on impact direction, as represented by the arrow labeled 30.

The embodiment shown and described with reference to FIGS. 1 through 5 is illustrative of the benefits realizable in many arrangements that may be constructed according to aspects, features and principles of the present invention. In the arrangement of FIGS. 1 through 5, the head engagement system 20 is provided in the form of a thin, vented bonnet or network of bands that is sized and shaped to fit generally around the circumference of a user's head and across the top of the user's head. External to the head engagement system 20 is the rigid outer structure 12 in the form of a shell that provides a standoff distance between the rigid outer structure 12 and the head engagement system 20 sufficient to meet a desired impact management performance. The standoff distance is maintained by the plurality of tethering devices 22 which may be maintained under slight or moderate tension when the helmet 10 is in the pre-impact configuration (i.e., the tethering devices may be pre-tensioned). The tension in the plurality of tethering devices 22 may be adjusted, such as, for example, adjusting a barrel adjuster, turnbuckle or other adjustment device or mechanism that may be coupled to or otherwise interact with the tethering devices 22.

One end of each tethering device 22 may be attached or fixed to the head engagement system 20, such as, for example, by an anchor connection 24. In some instances, the tethering devices 22 may be fixedly coupled to the anchor connections 24, and in other instances, may be adjustably coupled to the anchor connections 24. The other end of each tethering device 22 may pass through the rigid outer structure 12 to the exterior of the helmet 10 through an aperture 40 and be guided or directed to a respective damper 36, such as, for example, a tuned dashpot. In other instances, the tethering devices 22 may lead to dampers 36 embedded within the rigid outer structure or dampers 36 coupled within the interior of the rigid outer structure 12. Still further, it is appreciated that the dampers 36 may be positioned at the other opposing end of the tethering devices 22 coupled to the head engagement system 20. Placing the dampers outside the rigid outer structure 12, advantageously maintains the dampers 36 outside of the standoff space. Although not illustrated in the figures, the dampers 36 described herein may be surrounded by a protective cover or of protective structures.

Each damper 36 may be activated when an actuator portion thereof is pulled upon by the respective tethering device 22. The arrangement of tethering devices 22 and dampers 36 is such that an impact from any direction will cause one or more of the tethering devices 22 to be put under increased tension, as illustrated, for example, in FIGS. 4 and 5. The increased tension activates the associated damper(s) 36, which manage impact energy during an impact event as the space between the rigid outer structure 12 and the head engagement system 20 is decreased near the area of impact and/or the rigid outer structure 12 rotates relative to the head engagement system 20. In at least purely direct linear impacts, there is a direct relation between the standoff space and damper activation.

There are many advantages to protective gear having the type and arrangement of structures described above. Many such advantages are derived from the configuration flexibility afforded the features and structures discussed in particular with reference to FIGS. 1 through 5.

It is important that the tethering devices 22 sufficiently engage the dampers 36 during the desired range of impacts (e.g., high velocity, low velocity), location of impacts (e.g., front, side, rear) and types of impacts (e.g., inline, oblique). The tethering devices 22 can vary in number, location, type, extent, size, shape, material, connection (e.g., fixed, guided, or floating), and routing. Routing and connecting of the tethering devices 22 can employ pulleys, Bowden cables, levers, wheels, guiding channels, loops, grommets, eyelets or other suitable structures for routing and connecting the tethering devices 22 between the head engagement system 20 and the outer rigid structure 12. The tethering devices 22 can be woven intermittently or overlap each other. The tethering devices 22 may be threadedly attached or otherwise fastened or bonded to terminal structures. Functionally, the tethering devices 22 can be independent of each other or attached together in some manner.

It is also important that the outer rigid structure 12 be sufficiently rigid to support the functioning of the tethering devices 22 and the dampers 36 and to meet the requirements of safety standards when applicable. In some embodiments, the outer rigid structure 12 may be a closed hard shell as is called for in many helmet safety standards typical of motorsports and many sports. Conversely, in other embodiments, the outer rigid structure 12 can be open as is more typical of bicycling helmets, such as the example embodiment shown in FIG. 8.

It is important that the dampers 36 be configured to manage impact energy for the desired range of impacts (e.g., high velocity, low velocity), location of impacts (e.g., front, side, rear) and types of impacts (e.g., inline, oblique). Since the dampers 36 can be attached in nearly limitless positions, the dampers 36 can take on many shapes and forms as is best suited for a given application. The dampers 36 can be, for example, linear dampers or rotary dampers, or dampers having other configurations, such as a damper having a curvilinear profile. The dampers 36 may comprise a body or base portion having a linear, curvilinear, circular, or other shape. The body or base portion may support an actuator that is movably coupled thereto and which interacts with viscous dampening features when displaced linearly, rotationally or otherwise. Activation of the dampers 36 can be made in line with the tensioning devices 22, perpendicular thereto or oblique thereto. A pulling action can become a pushing action when the dampers 36 are engaged from the opposite side. As an example, the dampers 36 can employ a mechanical dashpot where upon activation a fluid is forced to flow through an orifice(s) or channels or other flow-restricting feature, or they can deform or crush a material or structure, or comprise some combination of such features. The dampers 36 can function independently of each other, or be linked or coupled in some manner, such as mechanically or hydraulically. Dry friction may also be employed in the dampers 36. The dampers 36 may also include one or more spring elements to help provide supplemental tension (or pre-tension) and/or a restorative force sufficient to reposition the helmet structures to a pre-impact configuration. The dampers 36 may also be adjustable to tune the dampening functionality thereof.

Figure 7:
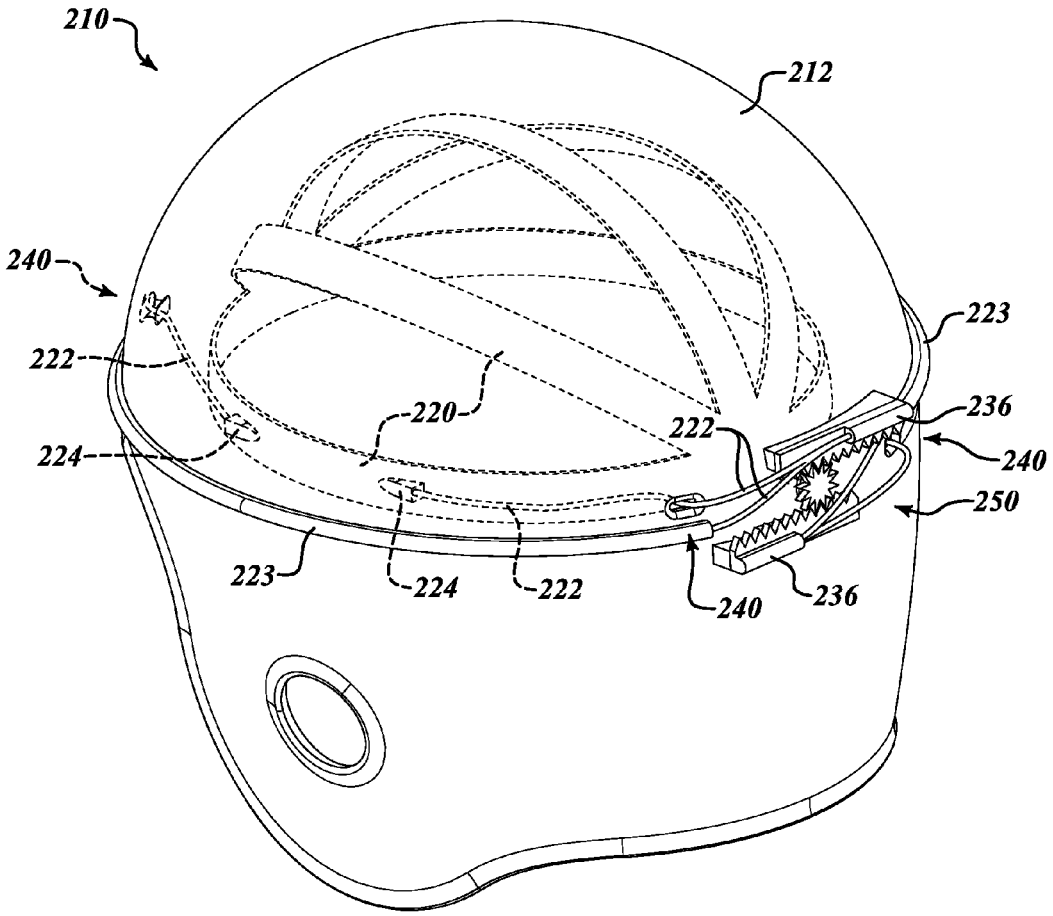
FIG. 7 is an isometric view of an article of protective headgear, according to yet another embodiment.
Figure 8:
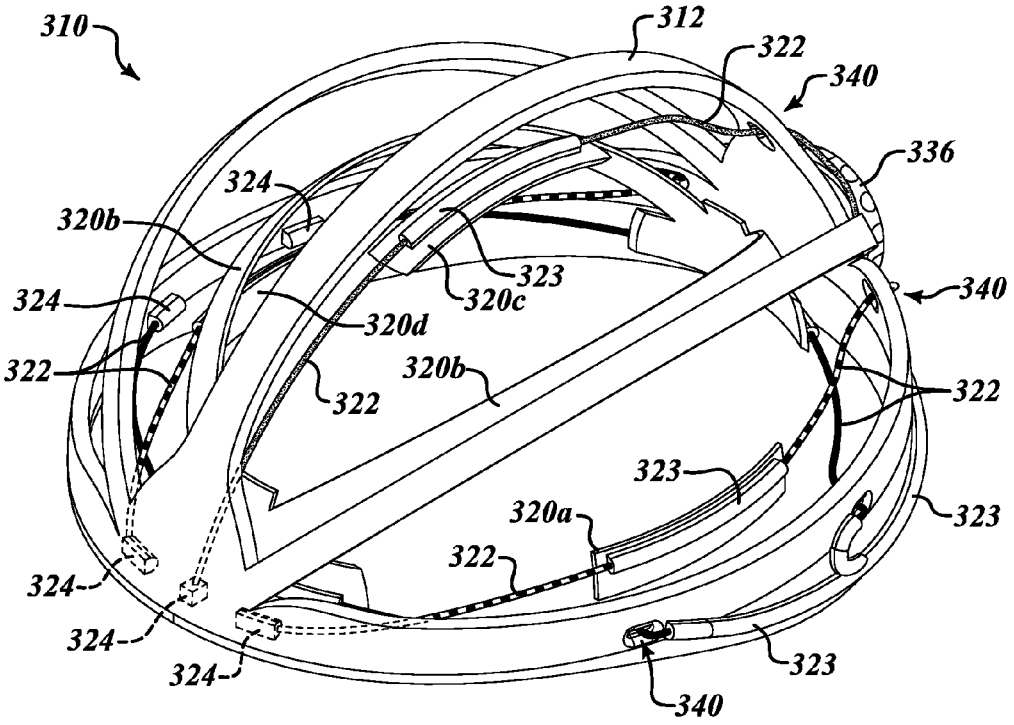
FIG. 8 is an isometric view of an article of protective headgear, according to still yet another embodiment.

Although the example embodiment of FIGS. 1 through 5 shows a system including twelve separate individual tethering devices 22 coupled to a like number of dampers 36 to manage impacts from a variety of directions, the tethering devices 22 and dampers 36 may be provided in a wide range of configurations and arrangements. Examples of just a few select, non-limiting variations of possible configurations and arrangements are shown in FIGS. 6 through 8.

Figure 6:
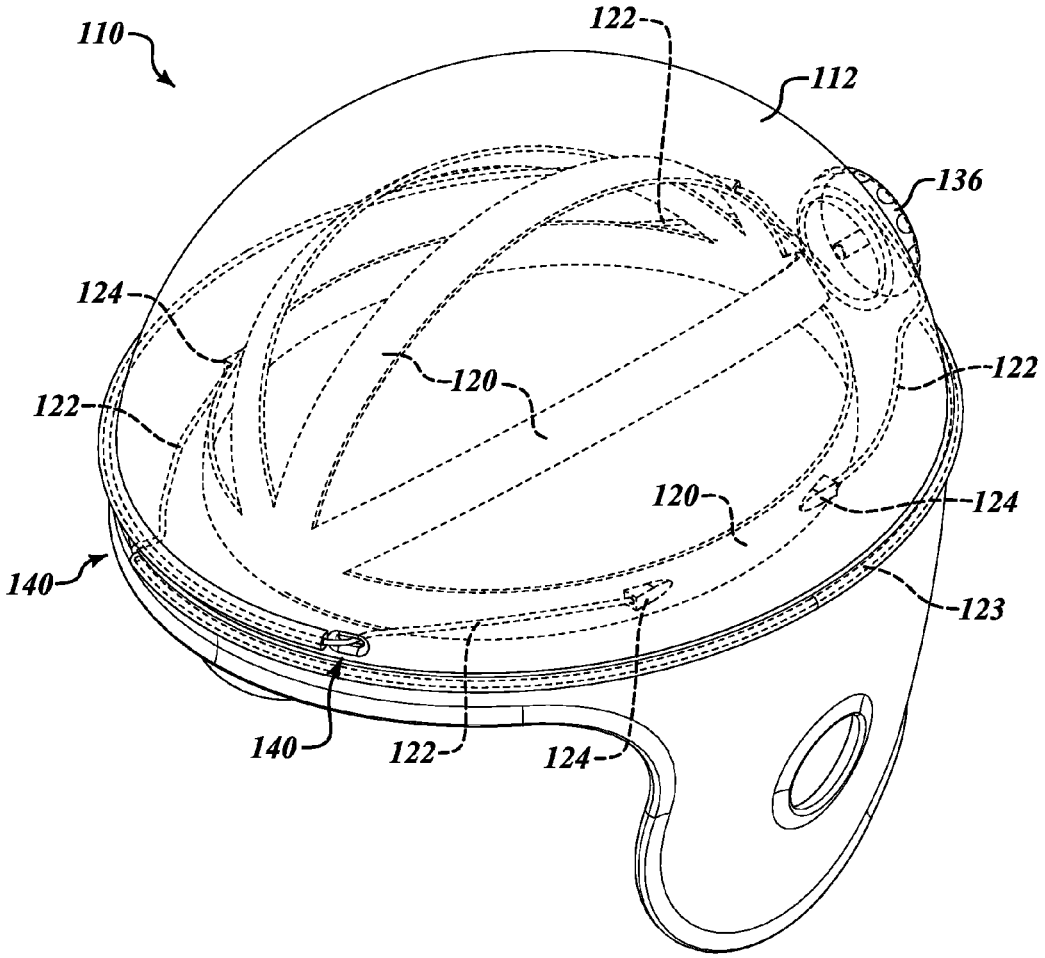
FIG. 6 is an isometric view of an article of protective headgear, according to another embodiment.

FIG. 6 shows, for example, another embodiment of an article of protective gear in the form of a helmet 110 wearable by a user to protect against impacts to the user's head. Similar to the helmet 10 of the embodiment shown in FIGS. 1 through 5, the helmet 110 includes an outer rigid structure 112, a head engagement system 120 that is configured to engage a user's head when the helmet 110 is worn and a plurality of tethering devices 122 that couple the head engagement system 120 to the outer rigid structure 112. The tethering devices 122 may couple the head engagement system 120 to the outer rigid structure 112 with the outer rigid structure 112 offset from the head engagement system 120 to provide a standoff space therebetween. The standoff space may be generally uniform or may vary in magnitude at different locations throughout the helmet 110. The tethering devices 122 may be in the form of flexible elongated structures, such as, for example, cables, bands, flexible rods, straps, ropes, wires or other structures.

The tethering devices 122 enable the head engagement system 120 and the outer rigid structure 112 to move relative to each other during impact events. More particularly, during an impact event, the outer rigid structure 112 may be displaced toward the head engagement system 120 near the area of impact (and/or rotated), causing one or more of the tethering devices 122 to increase in tension and become particularly taut, while causing one or more other tethering devices 122 to decrease in tension, and in some cases become slack.

The helmet 10 further includes a single rotary damper 136 that is configured to resist motion via viscous friction. The damper 136 is shown coupled to a rear portion of the helmet 110; however, it may be located in a wide range of locations. Each of the plurality of tethering devices 122 is connected to the rotary damper 136 such that the rotary damper 136 resists motion of the outer rigid structure 112 relative to the head engagement system 120 when the outer rigid structure 112 is impacted during an impact event as one or more of the tethering devices 122 pull on a rotary element of the rotary damper 136. In some embodiments, the rotary damper 136 may include a mechanism for adjusting a tension or pre-tension of the tethering devices simultaneously. For example, the rotary damper 136 may be coupled to the outer rigid structure 112 by a ratcheting mechanism that may be rotated to simultaneously increase tension in the tethering devices 122 connected to the rotary damper 136. In some instances, adjusting a tension of the tethering devices 122 may also operate to constrict the head engagement system 120 for purposes of adjusting a fit thereof. In this manner, adjusting or fitting devices can be integral to the tethering devices 122 and/or head engagement system 120.

As shown in FIG. 6, some of the tethering devices 122 may be routed from the head engagement system 120 through an aperture 140 in the rigid outer structure 112 and at least partially around the perimeter of the rigid outer structure to the centralized rotary damper 136. To assist in guiding the tethering devices 122 in this manner, one or more of the tethering devices 122 may include a sleeve 123 through which a flexible elongated element (e.g., wire or cable) of the tethering device 122 may slide during operation. In this manner, the tethering devices 122 may operate as or similar to a Bowden cable.

FIG. 7 shows another example embodiment of an article of protective gear in the form of a helmet 210 wearable by a user to protect against impacts to the user's head. Similar to the helmets 10, 110 discussed above, the helmet 210 includes an outer rigid structure 212, a head engagement system 220 that is configured to engage a user's head when the helmet 210 is worn, and a plurality of tethering devices 222 that couple the head engagement system 220 to the outer rigid structure 212. The tethering devices 222 may couple the head engagement system 220 to the outer rigid structure 212 with the outer rigid structure 212 offset from the head engagement system 220 to provide a standoff space therebetween. The standoff space may be generally uniform or may vary in magnitude at different locations throughout the helmet 210. The tethering devices 222 may be in the form of flexible elongated structures, such as, for example, cables, bands, flexible rods, straps, ropes, wires or other structures.

The tethering devices 222 enable the head engagement system 220 and the outer rigid structure 212 to move relative to each other during impact events. More particularly, during an impact event, the outer rigid structure 212 may be displaced toward the head engagement system 220 near the area of impact (and/or rotated), causing one or more of the tethering devices 222 to increase in tension and become particularly taut, while causing one or more other tethering devices 222 to decrease in tension, and in some cases become slack.

The helmet 210 further includes a pair of linear dampers 236 that are each configured to resist motion via viscous friction, and which are positioned in close proximity to each other. The dampers 236 are shown coupled to a rear portion of the helmet 210; however, they may be located in a wide range of locations, and may be located remote from each other. Some of the plurality of tethering devices 222 are connected to one of the linear dampers 236 and some of the plurality of tethering devices 222 are connected to the other one of the linear dampers 236. The pair of linear dampers 236 resist motion of the outer rigid structure 212 relative to the head engagement system 220 when the outer rigid structure 212 is impacted during an impact event and cause one or more of the tethering devices 222 to pull on an actuator of at least one of the pair of linear dampers 236.

As shown in FIG. 7, the helmet 210 may further include an adjustment mechanism 250 for adjusting a tension or pre-tension of the tethering devices 122. The adjustment mechanism 250 may interoperate with the dampers 236 to selectively reposition the dampers 236 to adjust a pre-tension of the tethering devices 222. The dampers 236 may be repositioned or adjusted simultaneously. For example, the dampers 136 may be coupled to a rack and pinion adjustment system or other adjustment system that is configured to move the dampers 236 concurrently. Additional adjustment or tuning may be provided in the dampers 236 themselves. Again, in some instances, adjusting a tension of the tethering devices 222 may also operate to constrict the head engagement system 220 for purposes of adjusting a fit thereof. In this manner, adjusting or fitting devices may be integral to the tethering devices 222 and/or head engagement system 220.

FIG. 8 shows yet another example embodiment of an article of protective gear in the form of a helmet 310 wearable by a user to protect against impacts to the user's head. The helmet 310 includes an outer rigid structure 312, a head engagement system 320 that is configured to engage a user's head when the helmet 310 is worn and a plurality of tethering devices 322 that couple the head engagement system 320 to the outer rigid structure 312. The tethering devices 322 may couple the head engagement system 320 to the outer rigid structure 312 with the outer rigid structure 312 offset from a profile defined by the head engagement system 320 to provide a standoff space therebetween. The standoff space may be generally uniform or may vary in magnitude at different locations throughout the helmet 310. The tethering devices 322 may be in the form of flexible elongated structures, such as, for example, cables, bands, flexible rods, straps, ropes, wires or other structures.

The tethering devices 322 enable the head engagement system 320 and the outer rigid structure 312 to move relative to each other during impact events. More particularly, during an impact event, the outer rigid structure 312 may be displaced toward the head engagement system 320 near the area of impact (and/or rotated), causing one or more of the tethering devices 322 to increase in tension and become particularly taut, while causing one or more other tethering devices 122 to decrease in tension, and in some cases become slack.

The example helmet 310 of FIG. 8 further includes a single rotary damper 336 that is configured to resist motion via viscous friction. The damper 336 is shown coupled to a rear portion of the helmet 310; however, it may be located in a wide range of locations. Each of the plurality of tethering devices 322 is connected to the centralized rotary damper 336 such that the rotary damper 336 resists motion of the outer rigid structure 312 relative to the head engagement system 320 when the outer rigid structure 312 is impacted during an impact event and causes one or more of the tethering devices 322 to pull on a rotary element of the rotary damper 336.

As can be appreciated from the example embodiment of FIG. 8, the head engagement system 320 may comprise a plurality of separate distinct portions 320*a-d* that collectively engage a user's head and, which in combination with the tethering devices 322, suspend the rigid outer structure 312 from the user's head when the helmet 310 is worn. Each separate distinct portion 320*a-d* may include a sleeve 323 or other structure for coupling the tethering devices 322 to the head engagement system 320 while also enabling the head engagement system to slide or ride on the tethering devices 322. In this manner, the head engagement system 320 may rotate and/or translate relative to the rigid outer structure 312 to a greater degree than in embodiments in which tethering devices are fixedly connected to the head engaging system. This may be particularly advantageous for protecting against oblique impacts.

As shown in FIG. 8, the rigid outer structure 312 may comprise a generally open shell structure, which can be advantageous in applications where it is desirable to minimize the weight of protective headgear and/or where enhanced ventilation is desired. The open shell structure of the helmet 310 shown in FIG. 8 is just one example of a vast array of structures that are possible. In fact, benefits and aspects of the systems described herein have broad application to helmets of all types and other protective gear where a hard outer shell or structure (open or closed) may be used. For example, shoulder pads, chest plates, shin guards and other protective gear may be provided having aspects of the impact management systems described herein.

Moreover, in some embodiments, an impact management system may be provided with a basic structure that consists of or comprises two structural components: a rigid outer structure or shell, and a combined suspending/dampening system that is activated through tension. The suspending/dampening system is intended to deform or stretch to manage impacts. It can be made of an elastic material like rubber or even a rate sensitive material under tension. Functionally, an external impact or "push" results in a "pull" on the suspending/dampening system as tension increases on at least a portion thereof. The suspending/dampening system can be pre-tensioned to provide a taut web of harness. A further variation may include a cradling device, such as a bonnet, to provide an interface for the user's head with possible integrated adjustments. The suspending/dampening system can have a variety of connection or suspending patterns, which will be determined by the nature of the materials employed, and the desired performance. The advantage of this approach may be simplicity and cost at the possible expense of optimal performance.

Still further, it is appreciated that features and aspects of the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. Protective headgear, comprising:

a rigid helmet structure defining a head receiving cavity;

an engagement system in the form of a bonnet structure positioned within the head receiving cavity of the rigid helmet structure and being configured to engage a user's head when the protective headgear is worn, the engagement system being separated from the rigid helmet structure with a standoff space therebetween;

a plurality of flexible tethering devices that suspendingly couple the bonnet structure to the rigid helmet structure within the head receiving cavity to provide the standoff space therebetween, each of the plurality of flexible tethering devices having opposing ends; and at least one damper fixedly attached to the rigid helmet structure, the damper having a base and an actuator movable relative to the base with movement of the actuator being guided and constrained by the base, and wherein a first end of the opposing ends of at least one of the flexible tethering devices is fixedly attached to the bonnet structure and a second end of the opposing ends of the at least one flexible tethering device is fixedly attached to the damper such that relative movement between the rigid helmet structure and the bonnet structure during an impact event is resisted by the damper as the flexible tethering device attached thereto causes the actuator to move relative to the base.

2. The protective headgear of claim 1 wherein the headgear comprises a plurality of dampers, and wherein each of the plurality of dampers include a base and an actuator movable relative to the base, the base of each damper being fixedly attached to the rigid helmet structure to move therewith, and the actuator of each damper being coupled to a respective end of a respective one of the plurality of flexible tethering devices.

3. The protective headgear of claim 1 wherein the at least one damper is arranged on the rigid helmet structure and oriented relative to the at least one flexible tethering device to resist motion as the damper is acted upon by a pulling force from the at least one flexible tethering device during an impact event.

4. The protective headgear of claim 1 wherein the rigid helmet structure and the bonnet structure are movable relative to each other between a pre-impact configuration and an impact configuration during impact events.

5. The protective headgear of claim 1 wherein the plurality of flexible tethering devices are arranged with one or more of the plurality of flexible tethering devices extending between the bonnet structure and the rigid helmet structure at a front end of the protective headgear and with one or more of the plurality of flexible tethering devices extending between the bonnet structure and the rigid helmet structure at a different location other than the front end of the protective headgear such that, when the rigid helmet structure and the bonnet structure are in an impact configuration corresponding to a front impact, the one or more of the plurality of flexible tethering devices at the different location are taut and the one or more of the plurality of flexible tethering devices at the front end of the protective headgear are slack.

6. The protective headgear of claim 1 wherein the at least one damper is arranged tangential to the rigid helmet structure such that, when an impact event causes the rigid helmet structure to move relative to the bonnet structure out of a pre-impact configuration, the at least one damper resists motion of the rigid helmet structure relative to the bonnet structure as the at least one flexible tethering device attached thereto pulls the actuator in a direction that is not aligned with a direction of the impact event.

7. The protective headgear of claim 1 wherein the at least one damper is configured such that, when an impact event causes the rigid helmet structure to move relative to the bonnet structure out of a pre-impact configuration, the at least one damper resists motion of the rigid helmet structure relative to the bonnet structure proportional to a relative velocity of the rigid helmet structure as the actuator moves relative to the base.

8. The protective headgear of claim 1 wherein the bonnet structure is configured to surround a circumference of the user's head and to extend across a crown of the user's head when the protective headgear is worn.

9. The protective headgear of claim 8 wherein each of the plurality of flexible tethering devices is coupled at one of opposing ends thereof to the bonnet structure and coupled at the other one of opposing ends thereof to the at least one damper.

10. The protective headgear of claim 9 wherein the bonnet structure is generally centrally located within the head receiving cavity of the rigid helmet structure when the protective headgear is in a pre-impact configuration.

11. The protective headgear of claim 9 wherein the rigid helmet structure and the bonnet structure are each sized and shaped such that the standoff space between the rigid helmet structure and the bonnet structure is generally uniform when the protective headgear is in a pre-impact configuration.

12. The protective headgear of claim 1 wherein the at least one damper includes at least one spring element to assist in returning the protective headgear to a pre-impact configuration after an impact event.

13. The protective headgear of claim 1 wherein the at least one damper comprises a linear or rotary dashpot.

14. The protective headgear of claim 13 wherein the at least one damper further comprises at least one spring element to assist in returning the damper to a pre-impact configuration after an impact event.

15. The protective headgear of claim 1 wherein, during an oblique impact event, the rigid helmet structure is configured to rotate and/or translate relative to the bonnet structure.

16. The protective headgear of claim 1, further comprising:

an adjustment mechanism to adjust fit of the bonnet structure.

17. The protective headgear of claim 1, further comprising:

an adjustment mechanism to adjust a pre-tension of one or more of the plurality of flexible tethering devices.

18. The protective headgear of claim 17 wherein the adjustment mechanism is configured to adjust the pre-tension of more than one of the flexible plurality of tethering devices simultaneously.

19. The protective headgear of claim 1 wherein the at least one damper is located exterior of the rigid helmet structure or embedded in the rigid helmet structure.

20. The protective headgear of claim 1 wherein the at least one damper is located within an interior region of the rigid helmet structure.

21. The protective headgear of claim 1 wherein each of the plurality of flexible tethering devices comprises a flexible elongated element having a stiffness such that any elongation of the flexible elongated element during an impact event is relatively small or negligible compared to a displacement the flexible elongated element imparts on an actuator of the damper to which the flexible elongated element is attached.

22. Protective headgear, comprising:

a rigid helmet structure defining a head receiving cavity;

a bonnet structure positioned within the head receiving cavity of the rigid helmet structure and being configured to engage a user's head when the protective headgear is worn, the bonnet structure and the rigid helmet structure being separated from each other to define a standoff space therebetween;

a plurality of flexible tethering devices coupled between the bonnet structure and the rigid helmet structure to suspend the rigid helmet structure from the user's head when the protective headgear is worn; and at least one damper comprising a base and an actuator movable relative to the base, the at least one damper directly coupled to the rigid helmet structure or the bonnet structure to move therewith and indirectly coupled to an opposite one of the rigid helmet structure and the bonnet structure via at least one of the flexible tethering devices, and wherein the rigid helmet structure is connected to and suspended from the bonnet structure solely by the plurality of flexible tethering devices and the at least one damper such that relative movement between the rigid helmet structure and the bonnet structure during an impact event is resisted by the damper as the relative movement causes corresponding movement of the flexible tethering device and in turn corresponding movement of the actuator of the damper relative to the base.

23. The protective headgear of claim 22 wherein the headgear comprises a plurality of dampers each having a base and an actuator movable relative to the base, wherein the base of the each damper is fixedly attached to the rigid helmet structure to move therewith, and wherein the actuator of each damper is coupled to a respective end of a respective one of the plurality of flexible tethering devices.

24. The protective headgear of claim 22 wherein the at least one damper is arranged on the rigid helmet structure and oriented relative to the at least one flexible tethering device to resist motion as the damper is acted upon by a pulling force from the at least one flexible tethering device during an impact event.

25. The protective headgear of claim 22 wherein the plurality of flexible tethering devices are arranged relative to the rigid helmet structure and the bonnet structure such that, when the rigid helmet structure and the bonnet structure are displaced from a pre-impact configuration, at least some of the plurality of flexible tethering devices undergo an increase in tension and cause the actuator and the base of the at least one damper to move relative to each other.

26. The protective headgear of claim 22 wherein the base of the at least one damper is fixedly coupled to the rigid helmet structure to move as a unit therewith and the actuator of the at least one damper is coupled indirectly to the bonnet structure via at least one of the flexible tethering devices.

27. Protective headgear, comprising:

a rigid helmet structure defining a head receiving cavity;

an engagement system in the form of a bonnet structure which is configured to engage a user's head when the protective headgear is worn and sized and shaped to fit within the head receiving cavity of the rigid helmet structure such that the engagement system and the rigid helmet structure are separated from each other to define a standoff space therebetween;

at least one motion resisting device fixedly attached to the rigid helmet structure or the bonnet structure, the at least one motion resisting device comprising a base and an actuator movable relative to the base and being configured to resist motion of the actuator relative to the base; and at least one flexible tethering device that extends across the standoff space with sufficient tension to suspend the bonnet structure within the head receiving cavity of the rigid helmet structure and, which is directly attached to the at least one motion resisting device such that movement of the rigid helmet structure relative to the bonnet structure causes corresponding movement of the least one flexible tethering device and in turn causes the actuator of the at least one motion resisting device to move relative to the base, thereby providing resistance to the movement of the rigid helmet structure relative to the bonnet structure.

28. The protective headgear of claim 27 wherein the at least one flexible tethering device is coupled along an intermediate portion thereof to one of the engagement system and the rigid helmet structure by a guide or sleeve.

29. The protective headgear of claim 27 wherein the motion resisting device is a dashpot with a material interceding between the base and the actuator which is displaced when the actuator moves relative to the base to assist in resisting motion.

* * * * *